US007657986B2

(12) United States Patent
Anders et al.

(10) Patent No.: US 7,657,986 B2
(45) Date of Patent: Feb. 9, 2010

(54) METHOD OF MAKING A FOLDED CONDENSER TUBE

(75) Inventors: James Anders, Williamsville, NY (US); Terry Joseph Hunt, Williamsville, NY (US); John Stanley Rosen, Jr., Williamsville, NY (US)

(73) Assignee: Delphi Technologies, Inc., Troy, MI (US)

( * ) Notice: Subject to any disclaimer, the term of this patent is extended or adjusted under 35 U.S.C. 154(b) by 366 days.

(21) Appl. No.: 11/649,610

(22) Filed: Jan. 4, 2007

(65) Prior Publication Data

US 2008/0164007 A1 Jul. 10, 2008

(51) Int. Cl.
*B23P 17/00* (2006.01)
*B23P 15/26* (2006.01)
*B21D 53/06* (2006.01)

(52) U.S. Cl. ..... 29/413; 29/412; 29/414; 29/416; 29/417; 29/890.053; 29/890.045; 29/890.07; 72/367.1

(58) Field of Classification Search ..... 29/890.07, 29/890.053, 890.054, 890.045, 890.03, 412–418; 72/367.1, 51, 135, FOR. 100, 379.6, 370.26, 72/129, 254; 165/182, 183, 76
See application file for complete search history.

(56) References Cited

U.S. PATENT DOCUMENTS 2,757,628 A 8/1956 Johnston
5,407,116 A 4/1995 Nishishita et al.
5,441,106 A * 8/1995 Yukitake ..... 165/183
6,615,488 B2 9/2003 Anders et al. ..... 29/890.053

FOREIGN PATENT DOCUMENTS

| | | |
|---|---|---|
| EP | 1 712 862 | 10/2006 |
| GB | 2 268 260 | 1/1994 |
| JP | 03 238165 | 10/1991 |

OTHER PUBLICATIONS

European Search Report dated Mar. 19, 2008.

* cited by examiner

*Primary Examiner*—David P Bryant
*Assistant Examiner*—Sarang Afzali
(74) *Attorney, Agent, or Firm*—Patrick M. Griffin

(57) ABSTRACT

A method of fabricating a condenser tube having a pre-determined tube length and multiple channels including the steps of forming an aperture in a flat strip of metal; moving the flat strip through a plurality of forming operations to fold into an enclosed tube containing channels, which channels include the aperture in their sides and bottoms; and severing the enclosed tube across the aperture to separate the enclosed tube into one condenser tube. The aperture eliminates the need for the channel sides to be severed, hence only the portion of the condenser tube enclosing the channels requires severing. Each pair of apertures is spaced from the next pair of apertures by the pre-determined tube length so that each sever produces one condensing tube of the pre-determined tube length with the apertures being divided into open notches. The invention also includes a heat exchanger utilizing the condenser tube with channel sides containing portions of the apertures.

3 Claims, 4 Drawing Sheets

METHOD OF MAKING A FOLDED CONDENSER TUBE

BACKGROUND OF THE INVENTION

1. Field of the Invention

The present invention relates to a condenser tube for use in a heat exchanger.

2. Description of the Prior Art

Heat exchangers normally include a pair of tanks or headers and a plurality of condenser tubes. The headers include header walls which are spaced from and face one another. The condenser tubes extend between the headers and convey cooling fluid through the header walls and into the closed headers. A plurality of fins extend between adjacent condenser tubes for transferring heat from the tubes to air passing through the heat exchanger to ultimately cool the fluid in the tubes. Such condenser tubes are frequently separated into a plurality of channels.

A method of forming a flat strip into such a condenser tube having two ends separated by a pre-determined tube length and two channels extending between the ends is disclosed in the U.S. Pat. No. 6,615,488 to Anders et al. The flat strip is progressively formed via a series of roller stations until the edges are folded into a pair of central abutting flanges engaging the inner surface of the strip along the center. The result is a continuous enclosed B-shaped tube with two channels extending the length of the tube and with the central abutting flanges forming channel sides which separate the channels from one another. The B-shaped tube is then severed to separate it into successive condenser tubes each of the pre-determined tube length.

It is also well known to produce such a condenser tube but having additional channels extending between the ends. The method includes moving the strip through a plurality of forming operations to form a continuous enclosed tube separated into channels by the longitudinally parallel channel sides and severing the enclosed tube to separate the enclosed tube into successive condenser tubes of the pre-determined tube length. Typical severing operations include sawing and die cutting.

In sawing, cutting residue contaminants, such as metal shavings or particles or cutting lubricants, penetrate the openings and either plug or otherwise contaminate the severed sides of the channels. Because of the small size of the individual channels, it is difficult to remove these contaminants.

In a die cutting operation, the blade of the die is moved across and through the entire enclosed tube to sever the exterior of the tube as well as the channel sides. Even with a new die and a sharp blade, some distortion of the channel sides occurs. As the blade dulls, the degree of the distortion increases and the severed edges of the individual condenser tubes become severely distorted.

Whichever severing technique is utilized, undesirable distortion and/or contamination occurs.

SUMMARY OF THE INVENTION AND ADVANTAGES

Accordingly, the invention provides such a heat exchanger utilizing the multi-channel condenser tube of the aforementioned type and a method of fabricating same by forming at least one aperture in the flat strip at the pre-determined tube length and positioning the aperture in the channel side separating the channels during the forming of the enclosed tube. The severing operation is further defined as severing the enclosed tube across the aperture without engaging the channel side for separating the enclosed tube into successive condenser tubes of the pre-determined tube length between tube ends with the aperture being divided into a notch in adjacent ends of successive condenser tubes.

By severing the enclosed tube across the aperture, the deformation and/or contamination of the ends of the condenser tube is eliminated because there is no severing contact with the channel side. When the condenser tube is installed in the heat exchanger, the notches are disposed within the header walls where they have no effect on the operation of the heat exchanger.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
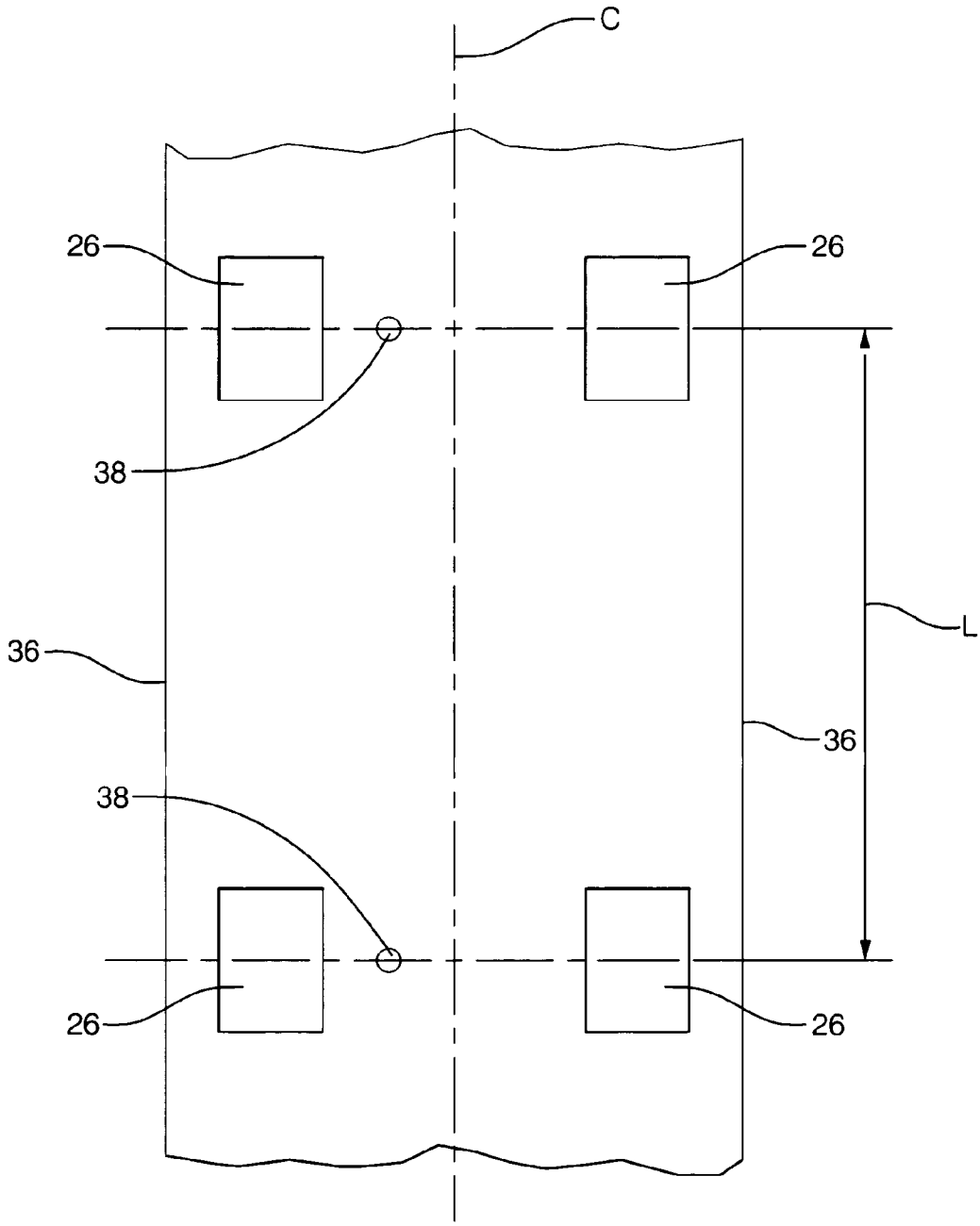
FIG. 1 is a perspective view of the flat strip cut away.

Referring to the Figures, wherein like numerals indicate corresponding parts throughout the several views, the invention provides a method of fabricating a condenser tube 20 having two ends separated by or defining a pre-determined tube length L and multiple channels 22 each of which having channel sides 24 and channel bottoms 25 extending the length of the condenser tube 20. The method comprises the steps of forming at least one aperture 26 in a flat strip 28 of metal at the pre-determined tube length L (shown in FIG. 1), moving the flat strip 28 of metal through a plurality of forming operations to fold or bend it into an enclosed tube 30 divided into closed channels 22 having channel sides 24 including the aperture 26 (shown in FIGS. 2A-M), and severing the enclosed tube 30 across the aperture 26 to separate the enclosed tube 30 into one condenser tube 20 of the pre-determined tube length L without engaging the channel sides 24. The severing step is performed successively, each time severing the enclosed tube 30 across the next, successive aperture 26 and between adjacent ends of successive condenser tubes 20 to separate the enclosed tube 30 into a plurality of condenser tubes 20. Upon severing through the aperture 26, the aperture 26 is divided into an open notch 31 in each of the adjacent ends of successive condenser tubes 20. In other words, the notch 31 in one end of one condenser tube 20 and the notch 31 in the adjacent end of the next condenser tube 20 are both formed from the same aperture 26.

Although the preferred embodiment includes multiple channels 22 defining multiple channel sides 24, the invention requires only one longitudinally extending channel side 24 separating the channels 22. It is in this longitudinally extending channel side 24 that the apertures 26, and subsequently the notches 31, are positioned.

The flat strip 28 of metal has a center line C that bisects the strip along its length, two outer edges 36 opposing one another on opposite sides of the center line C, and a middle portion. The flat strip 28 is preferably metal but could be of any material suitable for a condenser tube 20.

A plurality of pairs of apertures 26 are formed in the flat strip 28. Each of the pairs is spaced from the next pair by a distance equal to the pre-determined tube length L. Each of the pairs straddles the center line C. In other words, there is one aperture 26 on each side of the center line C as the respective pair is aligned transversely of the center line C. Both apertures 26 are equidistant from the center line C. The apertures 26 will be formed into the channel sides 24 and channel bottoms 25 as the channels 22 are formed via the forming operations. Alternatively, any number of apertures 26 could be formed and the size, shape, and number of the apertures 26 would depend on the design of the enclosed tube 30.

A hole 38 is formed in the flat strip 28 between the apertures 26 of each pair of apertures 26. The hole 38 will be utilized to error-proof the subsequent severing operation. The hole 38 is aligned transversely of the center line C. The position of the hole 38 between the apertures 26 of a particular pair on the flat strip 28 is such that the hole 38 will align under one of the apertures 26 in the channel sides 24 and channel bottoms 25 once the forming operations are completed. The severing operation employs a severing device. The severing device should cut and sever the enclosed tube 30 across the hole 38 and the apertures 26. If the severing device is not properly aligned, its cut will not pass through the apertures 26, and will consequently damage the channel sides 24.

The severed condenser tube 20 is installed between two headers 73 to define a heat exchanger, which is then charged with cooling fluid as is known in the art. Each header 73 includes a header wall 74 and the condenser tube 20 extends through each header wall 74 of the respective header 73. As the heat exchanger is operated, it is checked for leakage of cooling fluid through the hole 38. If the severing device was aligned properly and the condenser tube 20 was cut across the apertures 26, the hole 38 and the notches 31 will be disposed within the respective header wall 74, where a leak would have no effect on the operation of the heat exchanger. However, if the severing device was not properly aligned and the condenser tube 20 was not cut across the apertures 26, the hole 38 and the notches 31 will be disposed outside of the header wall 74, where the cooling fluid will leak through the notches 31 and the hole 38. As such, the leak would be easily detected.

For this error-proofing mechanism to function properly, the hole 38 must align under one of the apertures 26. Without being under one of the apertures 26, the cooling fluid cannot leak through the otherwise enclosed channel 22 and through the hole 38.

Figure 2G:
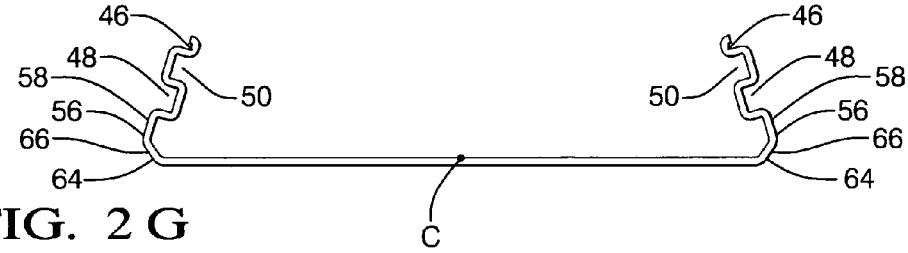
FIGS. 2A-M are schematics illustrating the successive steps in a method of fabricating the enclosed tube.
Figure 2F:
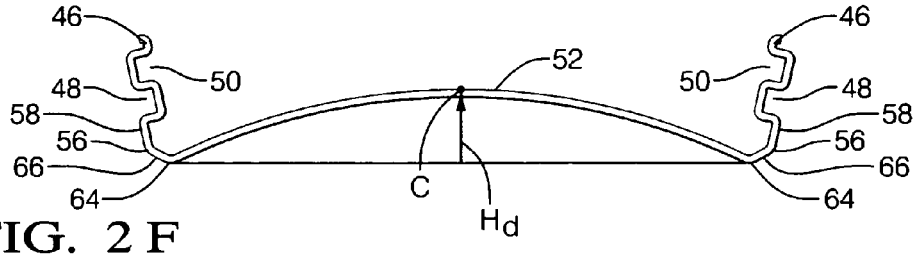
Figure 2E:
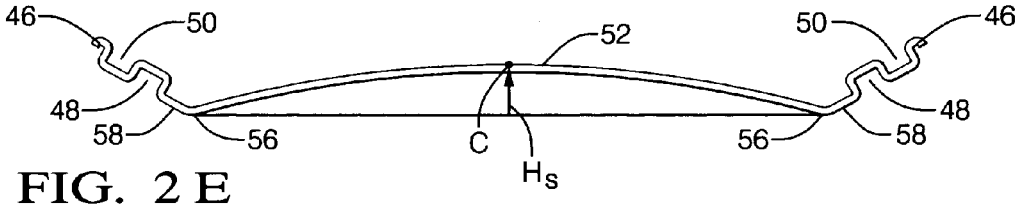
Figure 2D:
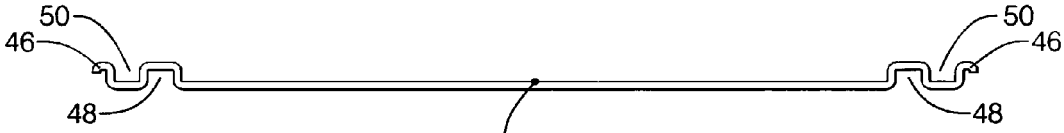
Figure 2C:
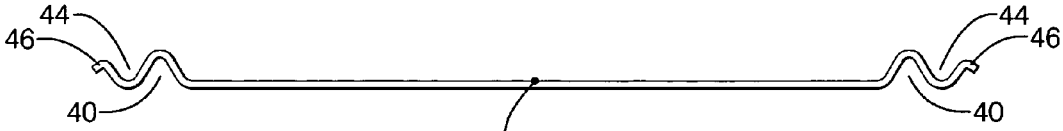
Figure 2B:
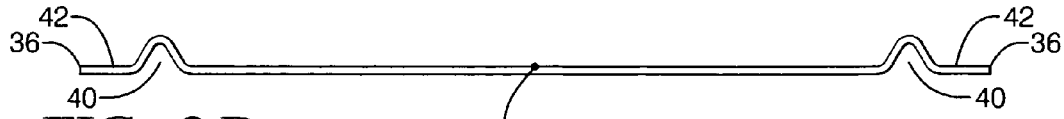
Figure 2A:
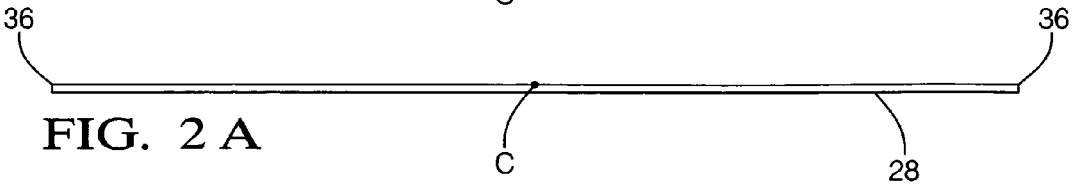

The first forming operation (after the forming of the apertures 26, shown in FIG. 2B, forms a downwardly facing first V shaped groove 40 inward of each outer edge 36. Each first V shaped groove 40 has diverging walls that extend along the length of the strip. This forming operation leaves a flat portion 42 of the strip between each first V shaped groove 40 and each adjacent outer edge 36. The flat portion 42 also extends along the length of the strip.

The next forming operation, shown in FIG. 2C, forms each flat portion 42 upwardly to form an upwardly facing second V shaped groove 44 immediately adjacent to the respective first V shaped groove 40. As such, each second V shaped groove 44 shares a common wall with the respective first V shaped groove 40. In other words, the outward wall of each first V shaped groove 40 and the inward wall of the respective second V shaped groove 44 are the same wall. This forming operation leaves a flange 46 extending from each second V shaped groove 44 to the adjacent outer edge 36.

Each of the first and second V shaped grooves 40, 44 are then formed into first and second U shaped grooves 48, 50, respectively, as shown in FIG. 2D. Each first U shaped groove 48 and each second U shaped groove 50 is generally rectangular in shape and has two sides which are substantially parallel to one another. Each first and second U shaped groove 48, 50 has a bottom. The bottoms of each of the first and second U shaped grooves 48, 50 are formed from the metal that previously formed the apices of the first and second V shaped grooves 40, 44, respectively. Each of the bottoms is generally perpendicular to and connects the respective sides and each of the second U shaped grooves 50 shares a common side with the respective first U shaped groove 48. The flange 46 extends from each second U shaped groove 50 to the adjacent outer edge 36.

Next, an upward bow 52 is formed in the middle portion of the flat strip 28 between the first and second U shaped grooves 48, 50 on each side of the center line C as shown in FIG. 2E. The upward bow 52 has a shallow height $H_s$ measured from the horizontal plane to the highest point of the upward bow 52. This forming operation also includes moving the two outer edges 36 upwardly to an inclined angle to form a first bend 56. By forming the upward bow 52, the outer edges 36 can be angled further upwardly. Without bowing the middle portion, the tooling could not achieve the inclined angle. Each first bend 56 is spaced inwardly from the respective first U shaped groove 48 by a third groove bottom piece 58. When the forming operations are complete, each of these third groove bottom pieces 58 will define the bottom of an additional third groove 60.

The next forming operation, shown in FIG. 2F, increases the height of the upward bow 52 to define a deep height Hd, which is taller than the shallow height $H_s$. This forming operation also includes moving the two outer edges 36 upwardly from the previous inclined angle to a position just short of vertical to form a second bend 64. Each second bend 64 is spaced inwardly from the respective third groove bottom piece 58 by a third groove side piece 66. When the forming operations are complete, each of these third groove side pieces 66 will be substantially perpendicular to the respective third groove bottom piece 58 and will define the outward side of the third groove 60.

The next forming operation, shown in FIG. 2G, straightens the upwardly bowed middle portion. In doing so, each of the two outer edges 36 are rotated inwardly to an angle slightly past vertical.

Figure 2M:
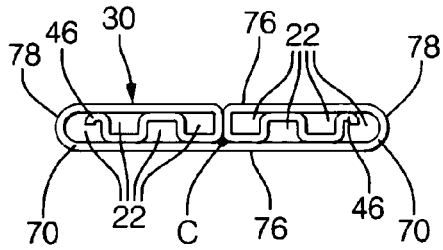
Figure 2L:
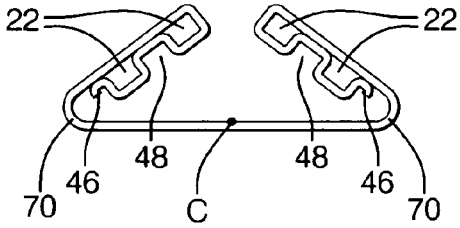
Figure 2K:
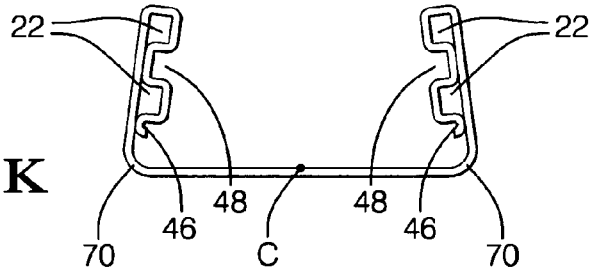
Figure 2J:
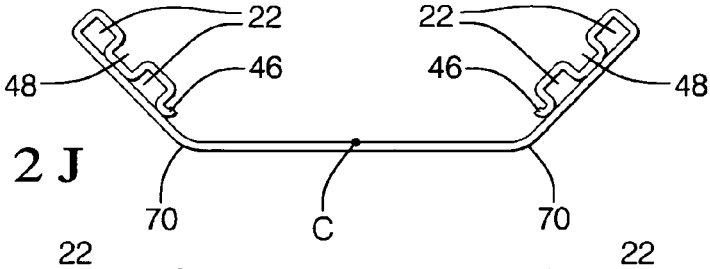
Figure 2I:
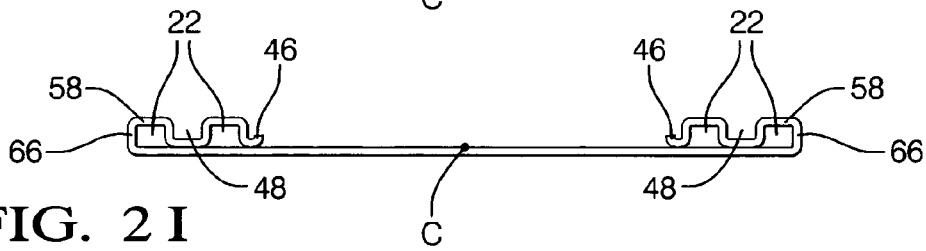
Figure 2H:
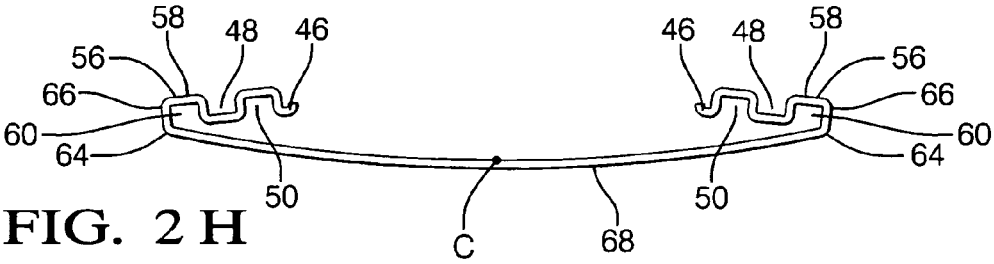

The next forming operation, shown in FIG. 2H, forms a downward bow 68 in the middle portion. This forming operation also moves the two outer edges 36 inwardly and downwardly toward one another and toward the middle portion of the flat strip 28. By forming the downward bow 68, the outer edges 36 can be angled further inwardly and downwardly. Without bowing the middle portion, the tooling could not achieve the desired angle.

The next forming operation, shown in FIG. 2I, straightens the downwardly bowed middle portion of the strip and moves the flanges 46 and the bottoms of the first U shaped grooves 48 downwardly to engage them with the middle portion. In doing so, the second U shaped grooves 50 and the third grooves 60 are closed and define channels 22. One channel 22 is formed by each second U shaped groove 50 with the sides of each second U shaped groove 50 becoming the channel sides 24 of the respective channel 22. Additionally, the bottoms of the second U shaped grooves 50 become the channel bottoms 25 of each of the respective channels 22. Another channel 22 is formed by each third groove side piece 66, the respective third groove bottom piece 58, and the adjacent wall of the respective first U shaped groove 48. The third groove bottom pieces 58 and the wall of the respective first U shaped groove 48 become the channel sides 24 and the third groove bottom pieces 58 become the channel bottoms 25 of each of these channels 22. These channels 22 are rectangular in cross section and extend the length of the strip. The first U shaped grooves 48, which were initially downwardly facing, now face upwardly and share channel sides 24 with the channels 22 defined by each second U shaped groove 50 and the respective third groove 60 on each side of the center line C.

The next forming operation, shown in FIG. 2J, forms a third bend 70 inward of each of the flanges 46 and moves the bottoms of the second and third grooves 60 rotationally and into engagement with the remaining middle portion. In doing so, the first U shaped grooves 48 are closed and define channels 22. One channel 22 is formed by each first U shaped groove 48 with the sides of each first U shaped groove 48 becoming the channel sides 24 of the respective channel 22 and the bottoms of each first U shaped groove 48 becoming the channel bottoms 25 of each of the respective channels 22. These channels 22 are rectangular in cross section and extend the length of the strip. Two additional channels 22 are defined as the bottoms of the second and third grooves 60 are rotated. These channels 22 are positioned outwardly of each of the second U shaped grooves 50 and inwardly of the adjacent third bend 70. Each of the respective outer sides of these channels 22 is rounded. By rotationally moving the bottoms of the second and third U shaped grooves 48, 50, as shown in FIGS. 2K, 2L, and 2M, the outward sides of the third grooves 60 abut and thereby enclose all of the channels 22 to produce a continuous enclosed tube 30 having eight channels 22 extending the length of the enclosed tube 30.

Figure 3:
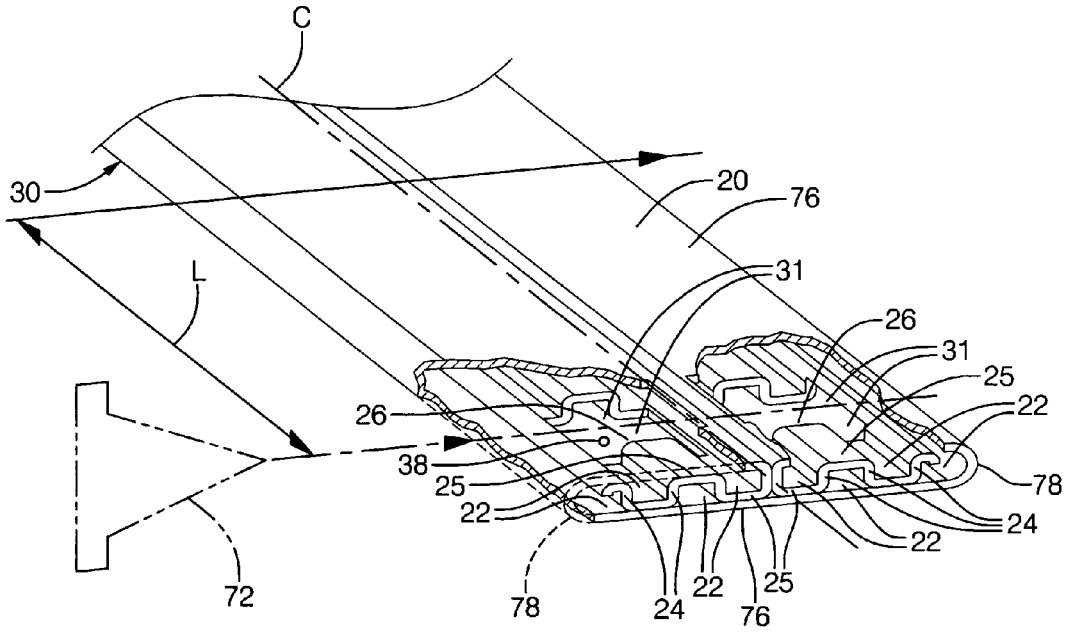
FIG. 3 is a fragmentary perspective view partially cut away and in cross section of the enclosed tube.

The continuous enclosed tube 30 is then severed, as by the blade 72, transversely across its width and across the apertures 26 to separate the continuous enclosed tube 30 into one condenser tube 20 of the pre-determined tube length L, as shown in FIG. 3. After the forming operations are completed, the apertures 26 extend transversely of the center line C and between the respective flange 46 and the respective abutted side of the third groove 60 of the enclosed tube 30. By severing the enclosed tube 30 across these apertures 26, the channel sides 24 are not engaged, and hence not distorted or otherwise damaged.

The severing is accomplished by moving the severing device across the enclosed tube 30. The recommended severing device is a blade 72. Once the cut is made, the blade 72 returns to its original position, where it remains until the next pair of apertures 26 is aligned into position. Successive severing operations yield successive condenser tubes 20. Because each pair of apertures 26 is spaced from the next pair by the pre-determined tube length L, each severing operation produces a condenser tube 20 of the pre-determined tube length L.

The apertures 26 in the channel sides 24 eliminate the need for the channel sides 24 to be severed, particularly from a broadside. As such, these portions of the channel sides 24 do not come in contact with the blade 72. Because no contact is made, there is no opportunity for the channel sides 24 to become contaminated, distorted, or otherwise damaged. The portion of the flat strip 28 that encloses the channels 22 still must be severed, however.

Figure 4:
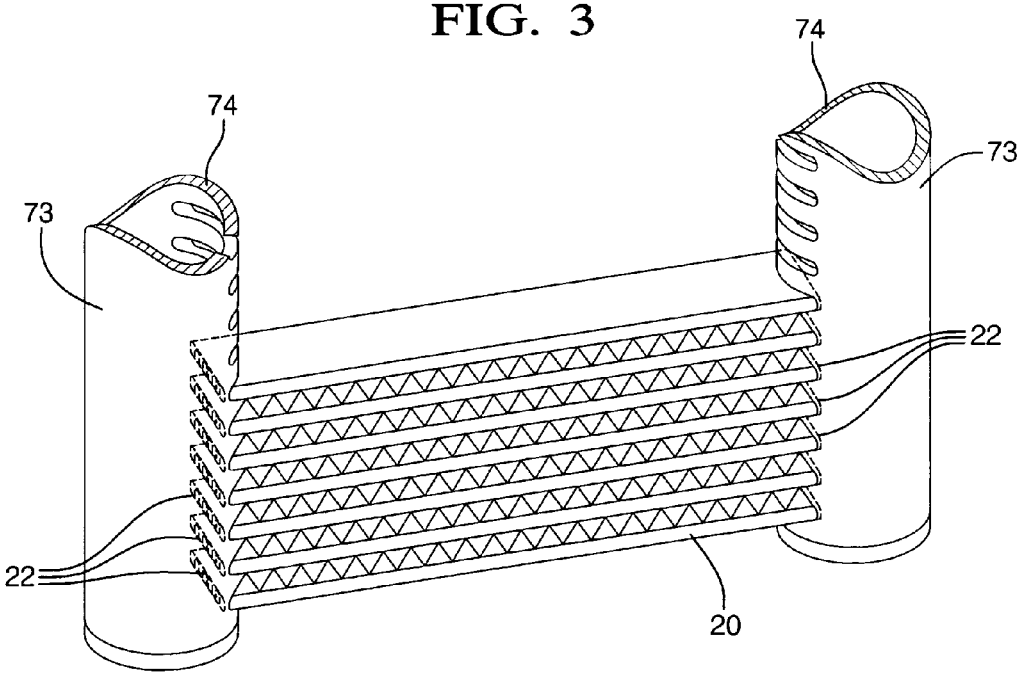
FIG. 4 is a front view of the heat exchanger assembly partially broken away and in cross section.

In addition to the method of the invention, the invention includes a heat exchanger assembly, shown in FIG. 4, comprising two headers 73 each of which headers 73 includes a header wall 74 with the header walls 74 spaced from and facing one another and the condenser tube 20 produced via the method. The condenser tube 20 extends between the headers 73 and through the header walls 74 and conveys cooling fluid through the header walls 74 and into the headers 73. The cooling fluid flows through the condenser tube 20, which has multiple channels 22 extending therethrough, and collects in each of the headers 73. A plurality of fins extends between adjacent condenser tubes 20 for transferring heat from the condenser tubes 20 to air passing through the heat exchanger to ultimately cool the fluid in the condenser tubes 20.

The condenser tube 20 has a center line C and two ends separated by the pre-determined tube length L. The center line C of the condenser tube 20 and the center line C of the flat strip 28 are the same center line C. The condenser tube 20 has a flat cross section with a pair of parallel and spaced tube walls 76 extending between rounded edges 78. The condenser tube 20 includes the plurality of U shaped channels 22 formed during the forming operations of the method. These channels 22 extend between the ends with each of the channels 22 having two parallel channel sides 24 and a channel bottom 25 perpendicular to and connecting said two channel sides 24 to form the U shape. Three U shaped channels 22 are disposed on each side of the center line C with one downwardly facing U shaped channel 22 sharing channel sides 24 with two upwardly facing U shaped channels 22. As mentioned above, these channels 22, including the respective channel sides 24 and channel bottoms 25, are formed and positioned during the forming operations of the method of the invention. The condenser tube 20 extends through a bend outwardly of each of said flanges 46. This bend defines the rounded edges 78 on each side of the condenser tube 20 and the bend defines two edge channels 22 extending along the length of the condenser tube 20.

Each of the upwardly facing U shaped channels 22 disposed next adjacent to the center line C has channel sides 24 abutting one another along the center line C. In other words, the two innermost U shaped channels 22 face upwardly and abut one another as they extend along the center line C. Immediately outward of each of these two upwardly facing U shaped channels 22 is one downwardly facing U shaped channel 22. One additional upwardly facing U shaped channel 22 is disposed immediately outwardly of each of the downwardly facing U shaped channels 22 and one edge channel 22 is disposed immediately outwardly of each of the outermost upwardly facing U shaped channels 22.

Alternatively, the number, shape, and disposition of the channels 22 could vary as is known in the art. However, the invention requires that there be at least one channel side 24 separating two channels 22.

A flange 46 extends generally horizontally from each of the upwardly facing U shaped channels 22 disposed most outwardly on each side of the center line C.

Each of the U shaped channels 22 includes the open notch 31 in the channel sides 24. The notch 31 extends transversely of the center line C from each of the flanges 46 to the respective abutting channel sides 24. The notch 31 is disposed adjacent each of the condenser tube 20 ends. As mentioned above, the notches 31 are a result of the enclosed tube 30 being severed across the apertures 26. It is the utilization of these apertures 26 in the severing step that prevents damage to the channel 22 walls that would be otherwise done by the blade 72 used to sever the condenser tube 20 to the pre-determined tube length L.

The tube also defines a hole 38 disposed transversely of the center line C. The hole 38 is aligned on each of the condenser tube 20 ends and under one of the apertures 26. The hole 38 is used to verify that the notches 31 are disposed within the header walls 74. When the hole 38 is disposed within the header walls 74, a leak therethrough has no effect on the operation of the heat exchanger. However, if the hole 38 were to be disposed outside of the header walls 74, cooling fluid would leak through the aperture 26 and the hole 38 and would be easily detected. As mentioned above, this leak would signify that the condenser tube 20 was not severed across the respective apertures 26.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for fabricating a condenser tube having a pre-determined tube length and multiple channels extending the length of the tube comprising the steps of;

moving a flat strip of metal having a center line and outer edges extending the length of the strip through a plurality of forming operations, forming a downwardly facing first V shaped groove extending the length of the strip and positioned inwardly of each outer edge of the strip leaving a flat portion of the strip between each first V shaped groove and each adjacent outer edge, forming an upwardly facing second V shaped groove in the flat portion and a flange extending to the adjacent outer edge, forming the first and second V shaped grooves into first and second U shaped grooves having first and second groove bottoms and sides, forming an upward bow having a shallow height in the middle portion of the strip between the grooves along the respective edges and moving the two outer edges upwardly to an inclined angle to form a first bend spaced inwardly from the first U-shaped groove the width of a bottom of a third groove, increasing the height of the upward bow to define a deep height and moving the two outer edges upwardly from the inclined angle to a position just short of vertical to form a second bend spaced inwardly from the width of the bottom to define a third groove side extending along the strip, straightening the upwardly bowed middle portion to rotate the two outer edges inwardly past vertical, forming a downward bow in the middle portion and moving the two outer edges inwardly and downwardly toward one another and toward the middle portion, straightening the downwardly bowed middle portion of the strip and moving the flanges and the bottoms of the first U shaped grooves downwardly and into engagement with the middle portion to close the second and third U shaped grooves to define respective channels and leaving the first U shaped groove opening upwardly between the second and third U shaped grooves, forming a third bend inwardly of each of the flanges and moving the bottoms of the second and third U shaped grooves into engagement with the middle portion to close the first U shaped grooves to define a channel and to abut the sides of the third grooves to define a channel positioned outwardly of each of the second U shaped grooves and inwardly of each third bend to produce an enclosed tube having eight channels extending the length of the enclosed tube, and severing the enclosed tube for separating the enclosed tube into successive condenser tubes each of the pre-determined length.

2. A method for fabricating a condenser tube having a pre-determined tube length and multiple channels extending the length of the tube comprising the steps of;

moving a flat strip of metal having a center line and outer edges extending the length of the strip through a plurality of forming operations, forming a plurality of pairs of rectangular apertures in the flat strip with each of the pairs straddling the center line at the pre-determined tube lengths and aligned transversely of the center line, forming a downwardly facing first V shaped groove extending the length of the strip and positioned inwardly of each outer edge of the strip leaving a flat portion of the strip between each first V shaped groove and each adjacent outer edge, forming an upwardly facing second V shaped groove in the flat portion and a flange extending to the adjacent outer edge, forming the first and second V shaped grooves into first and second U shaped grooves having first and second groove bottoms and sides, forming an upward bow having a shallow height in the middle portion of the strip between the grooves along the respective edges and moving the two outer edges upwardly to an inclined angle to form a first bend spaced inwardly from the first U-shaped groove the width of a bottom of a third groove, increasing the height of the upward bow to define a deep height and moving the two outer edges upwardly from the inclined angle to a position just short of vertical to form a second bend spaced inwardly from the width of the bottom to define a third groove side extending along the strip, straightening the upwardly bowed middle portion to rotate the two outer edges inwardly past vertical, forming a downward bow in the middle portion and moving the two outer edges inwardly and downwardly toward one another and toward the middle portion, straightening the downwardly bowed middle portion of the strip and moving the flanges and the bottoms of the first U shaped grooves downwardly and into engagement with the middle portion to close the second and third U shaped grooves to define respective channels and leaving the first U shaped groove opening upwardly between the second and third U shaped grooves, forming a third bend inwardly of each of the flanges and moving the bottoms of the second and third U shaped grooves into engagement with the middle portion to close the first U shaped grooves to define a channel and to abut the sides of the third grooves to define a channel positioned outwardly of each of the second U shaped grooves and inwardly of each third bend to produce an enclosed tube having eight channels extending the length of the enclosed tube, wherein said plurality of pairs of rectangular apertures are extending transversely of the center line between the flanges and the abutting sides of the third grooves, and severing the enclosed tube for separating the enclosed tube into successive condenser tubes each of the pre-determined length, and wherein said severing is further defined as severing the enclosed tube across the apertures for separating the enclosed tube into successive condenser tubes of the pre-determined tube length between ends with the aperture divided into a notch in adjacent ends of successive condenser tubes.

3. A method as set forth in claim 2 including the steps of;

forming a hole in the flat strip aligned transversely of the center line and between the apertures to be disposed under the apertures during the forming of the enclosed tube, installing the condenser tube between two headers to define a heat exchanger, charging the heat exchanger with cooling fluid, and checking for leakage of cooling fluid from the hole to verify that the hole and the notches are disposed within the headers to verify that the condenser tube was severed across the apertures.

* * * * *